US006142705A

United States Patent [19]

Edwards et al.

[11] Patent Number: 6,142,705

[45] Date of Patent: Nov. 7, 2000

[54] POND MANAGEMENT SYSTEM

[76] Inventors: Horace Clifton Edwards, 677 Phelps Rd., Louisburg, N.C. 27549; George E. Wells, 113 Ivy La., Raleigh, N.C. 27609

[21] Appl. No.: 09/296,629

[22] Filed: Apr. 23, 1999

[51] Int. Cl.[7] ..... F04F 10/00

[52] U.S. Cl. ..... 405/127; 405/53; 137/143

[58] Field of Search ..... 137/143, 142, 137/577, 590.5; 405/36, 37, 39, 40, 41, 127

[56] References Cited

U.S. PATENT DOCUMENTS

| | | | |
|---|---|---|---|
| 810,879 | 1/1906 | Perry . | |
| 1,123,888 | 1/1915 | Kempf . | |
| 1,131,823 | 3/1915 | Clevenger . | |
| 1,271,813 | 7/1918 | Walker | 137/143 |
| 3,927,534 | 12/1975 | Larson et al. | 405/127 |
| 4,059,126 | 11/1977 | Nickerson | 137/142 |
| 5,080,528 | 1/1992 | Ressi Di Cervio | 405/38 |
| 5,566,706 | 10/1996 | Harpenau | 137/152 |
| 5,921,267 | 7/1999 | Lin | 137/590.5 |

FOREIGN PATENT DOCUMENTS

| | | | |
|---|---|---|---|
| 50328 | 12/1909 | Switzerland | 137/143 |

*Primary Examiner*—Eileen D. Lillis
*Assistant Examiner*—Frederick L. Lagman

[57] ABSTRACT

A method of managing ponds that have standpipe overflows, such method including installing of a capped sleeve over the standpipe with the horizontal area between the wall of the sleeve and the wall of the standpipe being equal to or greater than the horizontal cross-section area of the standpipe. Opening a valve in the top of the standpipe to allow normal flow of the water from the pond through the standpipe by equalizing atmospheric pressure on the interior and exterior of the capped sleeve. Closing the valve in the cap of the sleeve to allow the water flow to create a vacuum in the top of the capped sleeve thus increasing water flow through the standpipe to full capacity. The draw down can continue until the interior vacuum is broken by the water reaching the bottom of the sleeve or the valve can be opened prior thereto to stop the draw down at any desired level. If the normal water level is below the mouth of the standpipe, but above the bottom of the sleeve, a vacuum can be pulled through the valve means to raise the water in the capped sleeve until it flows through the standpipe to drop the pond level.

8 Claims, 3 Drawing Sheets

POND MANAGEMENT SYSTEM

BACKGROUND OF INVENTION

Field of Invention

This invention relates to pond management systems and more particularly to drainpipe trash control and pond draw-down systems.

BACKGROUND OF INVENTION

Man-made ponds and small lakes usually have vertical standpipes that are connected to a drainpipe that runs through the lower part of the dam. Emergency spill ways with a level above the normal pond level are cut into undisturbed earth at one end of the dam to handle storm overflow or overflow if the standpipe becomes clogged.

During fertilizing of ponds for fish growth, much of the fertilizer is lost by flowing down the standpipe since the fertilizer remains close to the surface.

It is also desirable to draw down ponds for various reasons including preparing recreational areas, repairing and building docks, eliminating vegetation, promoting fish growth and meeting environmental concerns such as dam inspection and repair, silt and erosion control and the like. Up until now there has been no easy method of accomplishing this.

Examples of the above, large pipes have been used to siphon the water from the pond, drainpipes have been drilled through the dam to drain water to a pre-determined level, tilting the drainpipe to lower the inlet end thereof and other similar laborious, time consuming methods have been used.

Concise Explanation of Prior Art

U.S. Pat. No. 810,879 to Benjamin Franklin of Perry Todds Point Township, Ill., assignor of one half interest to Charles Beveraly Davis of Todds Point Township, Ill. entitled Water-Escape is a trash controlled in the form of a sleeve that is mounted on a standpipe and extend a substantial distance thereabove with a grate in the upper end of the sleeve.

U.S. Pat. No. 1,131,823 to Frank A. Clevenger of Ekalka, Mont. entitled Irrigation-Siphon is a device placed in a stream or the like to facilitate conveying of water to places where it is necessary to irrigate land in view of extended drought. A valve in the top of the device is used to control the flow and to allow the bottom portion 6 to at all times remain submerged for continuous siphon.

U.S. Pat. No. 1,123,888 to John W. Kempf of Shickley, Nebr. entitled Fender or Cap for Vertically-Disposed Drainage-Pipes allows water to pass freely through the system while trash and other foreign matter is prevented from passing therethrough.

U.S. Pat. No. 4,059,126 to Malcolm Hoarce Nickerson of Chagrin Falls, Ohio, assigned to B. F. Goodrich Company of Akron, Ohio entitled Solar Activated Siphon Drain is a solar operated siphon used to automatically drain water from areas such as flat roofs of buildings.

Finally, U.S. Pat. No. 5,566,706 to Richard J. Harpenau of Tequesta, Fl. entitle Siphon Device to Obtain Desired Water Levels in Pools and the Like is nothing more than a pipe stuck down into a swimming pool with a hose that runs to a point below the siphon tube so that the water siphons until the vacuum is broken.

BRIEF DESCRIPTION OF INVENTION

After much research and study into the above mentioned problems, the present invention has been developed to provide a means for effectively controlling trash and debris from entering and thus obstructing the drainpipe. The present invention also allows normal drainpipe flow at its normal level while including a simple means to create a siphon within the drainpipe to lower the level of the pond to any desired level or to the bottom of the system.

The above is accomplished by providing a sleeve that slips over the drain pipe and is supported above the top thereof. The side of the sleeve is spaced apart from the drainpipe with the horizontal cross section of this space being equal to or greater than the horizontal cross-section of the drainpipe. At least one ball valve is provided in the present invention which communicates to the interior of the sleeve above the drain pipe.

As long as the ball valve is open, the drain pipe functions normally. If the ball valve is closed while water is flowing into the drainpipe, a vacuum will be created by the flow of the water which will raise the water in the sleeve with greater and greater flow through the drainpipe until the sleeve is completely filled, at which time the flow of the water will reach its maximum. In other words, the greater the head of water, the greater the flow in pressure and volume.

If a pond level less than the bottom of the sleeve is desired, when that level is reached, the ball valve is simply opened, releasing the vacuum in the top of the sleeve which will stop the flow of water at that point. The level of the pond will, of course, slowly begin to rise if there is an inlet flow to such pond. But by then the inspections, recreational work or other reasons for lowering the water should be completed.

If the ball valve is not opened, when the water level gets to the bottom of the sleeve, the vacuum will be broken in the sleeve causing the siphon flow will cease.

In view of the above, it is an object of the present invention to provide a relatively simple and yet highly efficient means for controlling trash and debris from entering standpipe as well as allowing the levels of the pond to be controlled for pond management.

Another object of the present invention is to provide a means for accurately controlling the water level in a pond for pond management purposes.

Another object of the present invention is to provide a method of managing ponds including means to accurately control water levels to allow marine growth to be controlled.

Another object of the present invention is to provide a method of managing ponds including means to prevent trash from clogging standpipe accurately controlling water levels to allow recreational work to be conducted.

Another object of the present invention is to provide a method of managing ponds including means to control water levels to allow dock construction and repairs, and inspections for environmental concerns such as dam inspection and repair, silt and erosion control and the like.

Other objects and advantages of the present invention will become apparent and obvious from a study of the following description and the accompanying drawings which are merely illustrative of such invention.

DETAILED DESCRIPTION OF INVENTION

Figure 1:
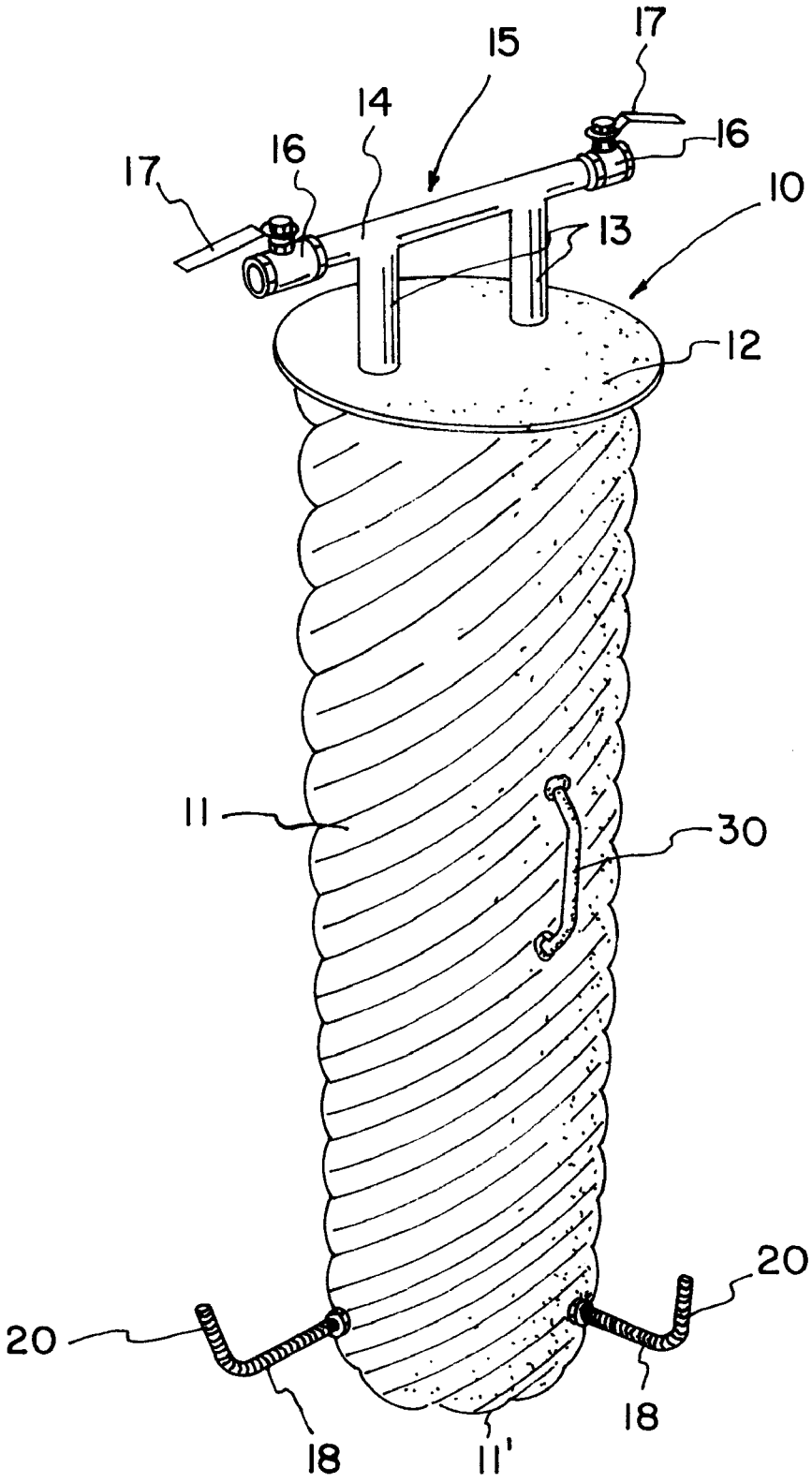
FIG. 1 is a perspective view of the drainpipe trash control I/and pond draw down portion of the present pond management system.
Figure 3:
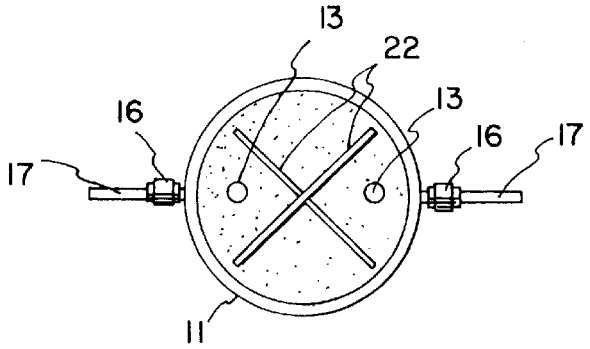
FIG. 3 is a sectional view taken through FIG. 2.

The pond management system of the present invention, indicated generally at 10, is composed of a sleeve portion 11 with a sleeve cap 12 at one end.

Air pipes 13 communicate with the interior of the pond management system 10. A cross-pipe 14 communicatively connects to air pipes 13 to form a π-shaped handle, indicated generally at 15.

On opposite ends of the cross pipe 14 are ball valves 16 that are operated by handles 17. Since ball valves are well known to those skilled in the art, further detailed discussion of the same is not deemed necessary.

In addition to the π-shaped handle 15, a second lift handle 30 is provided on the exterior of sleeve portion 11. Through the use of these two handles, the pond management system 10 can be manipulated into operative position as will hereinafter be described in greater detail.

A plurality of adjustable standoffs 18 are provided which are threaded through the lower portion of the sleeve portion 11 using nuts 19 that are welded or otherwise secured to such sleeve. Thus by turning the handle portion 20 of the standoffs 18, the pond management system can be properly spaced around the pond standpipe 21. At least three standoffs are provided and they are adjusted to a distant, slightly less than the standpipe so that it will easily slide down the same when being installed thereover.

Figure 2:
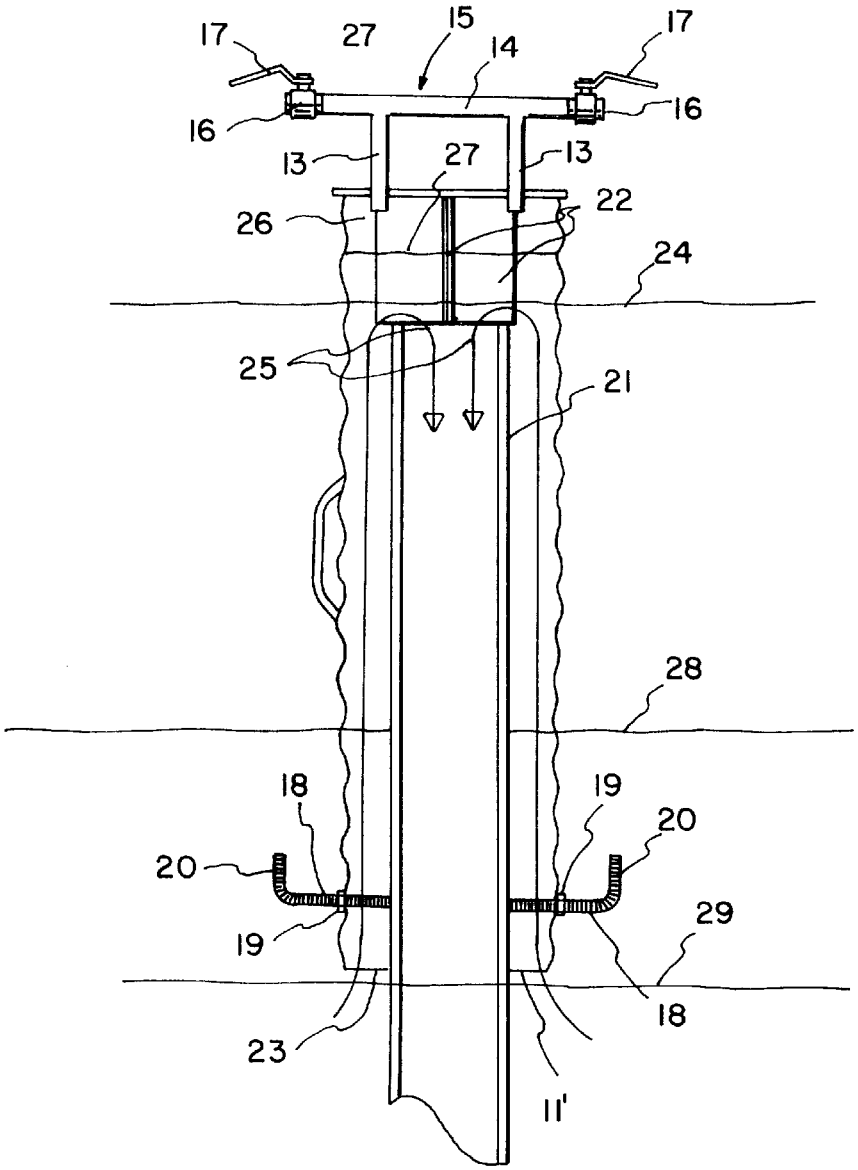
FIG. 2 is a vertical sectional view thereof.
Figure 4:
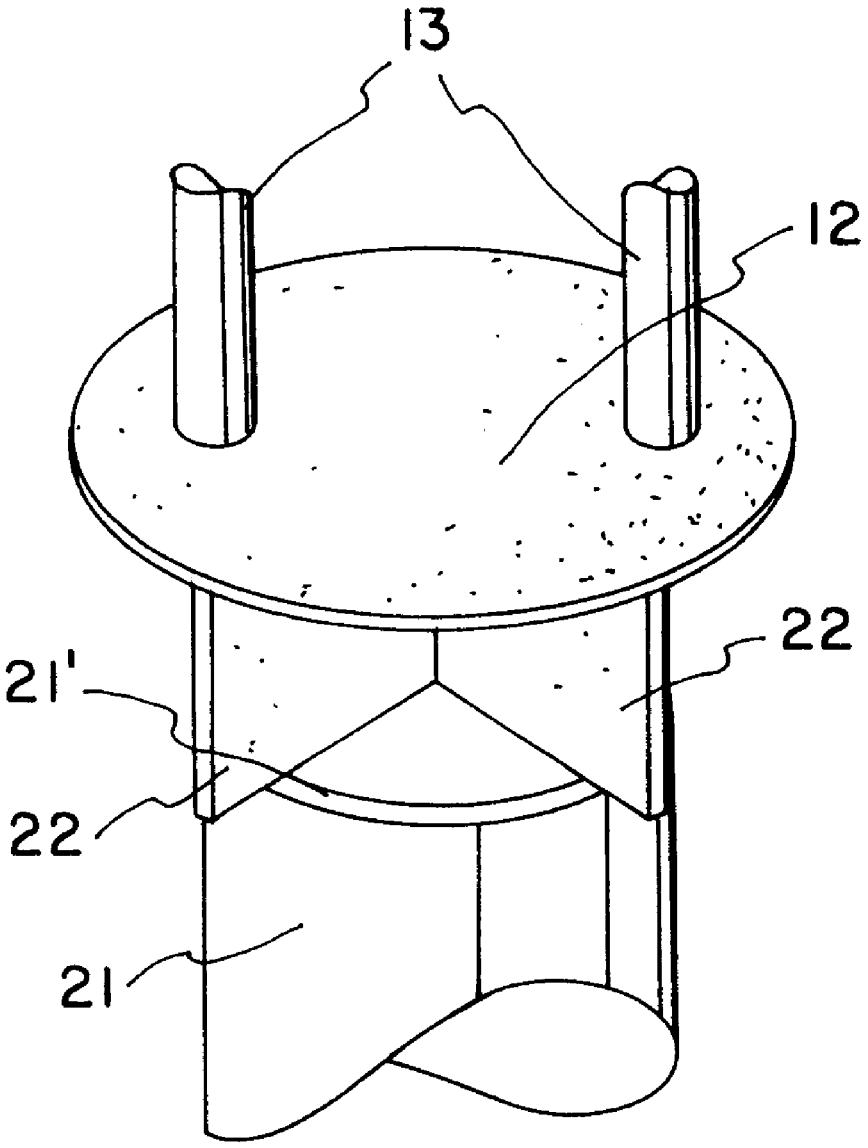
FIG. 4 is a cut-away sectional view showing the spacers on top of standpipe supporting the sleeve cap.

Flat vertical spacers 22 are used to maintain the sleeve cap 12 of the pond management system 10 at a predetermined distance from the top of the standpipe 21 as can clearly be seen in FIG. 2. These vertical spacers do not, of course, impede the flow of water but assure that water can freely flow up through the sleeve portion 11 and down the standpipe 21 during normal pond overflow.

To use the pond management system of the present invention, the standoffs are adjusted to a distance apart that is slightly greater than the outside diameter of the standpipe 21. The handles 15 and 30 are grasped and manipulated to slide the sleeve portion 11 over the standpipe until the top of such standpipe has vertical spacers 22 resting thereon.

Water can normally flow through the flow space 23 between the interior of the sleeve portion 11 and the exterior of the standpipe 21. It should be noted that the horizontal cross-section area of this space is equal to or greater than the horizontal cross-section area of the standpipe.

The pond management system 10 can be installed on the standpipe 21 when the pond water at normal level 24 and will overflow into such standpipe. Once installed as shown in FIG. 2 with at least one of the ball valves 16 open, the interior of the system is at atmospheric pressure and water will flow as indicated at 25 through the bottom of the sleeve portion 11, up and over the top of the standpipe 21, and drain out therefrom in the normal manner.

When it is desired to drop the water level 25 of the pond, the ball valve handles 17 are used to close the ball valves 16. The flow of water 25 through the standpipe 21 will begin to evacuate the interior head area 26 between the top 21' of the standpipe 21 and the sleeve cap 12. As this area is evacuated, the water level within such area will rise as indicated at 27. As this water level rises, more water flow 25 will enter the standpipe 21. Very quickly the head area 26 will be completely evacuated giving maximum full flow of water through the standpipe 21. This fill flow of water through the standpipe 21 will rapidly lower the water level 24 of the pond.

When a desired water level 24 has been reached that is less than the bottom 11' of the sleeve portion 11, at least one of the ball valves is opened, breaking the vacuum in the head 26 and stopping the water flow as indicated at 28.

If, of course, the ball valve is not opened, the water level will continue to drop until it reaches the level indicated at 29 wherein air can enter the interior of the management system 10, returning the interior head area 26 to atmospheric pressure.

When the pond management system 10 of the present invention is installed on the standpipe 21 and the water level 24 is below the top 21' of the standpipe with no water flowing therethrough, so long as the ball valves remain open this static condition will remain. If, however, it is desired to drop the water level further, one of the ball valves is closed and the other is connected to a means for creating a vacuum (not shown). As the atmospheric pressure in the head area 26 is reduced, the atmospheric pressure on the water of the pond will force water further and further up the flow space 23 until the water begins to flow through the standpipe 21. The vacuum can then be removed from the ball valve and such valve closed. The flow will increase until the maximum flow is reached as hereunder described.

The present invention is a multi-functional system that prevents debris from clogging the standpipe, prevents loss of fertilizer that is being added to stimulate fish growth, and allows the pond level to be adjusted at any level from normal flow level to the bottom of the sleeve. Using this system, pond maintenance and fish growth can be controlled in a simple manner not heretofore possible.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. In ponds and small lakes having standpipe overflows, a method of complete pond management including preventing of clogging of the overflow from debris, preventing loss of fertilizer added to the pond to promote fish growth and addressing environment concerns comprising:

installing a capped sleeve having at least one exterior valve means communicating with the interior of the sleeve over the standpipe and providing standoff means in the lower portion of the sleeve to hold the sleeve in predetermined spaced relation with the standpipe, the cross-section area between the sleeve and the standpipe being equal to or greater than the cross-section area of the stand pipe;

leaving the valve means open to equalize atmospheric pressure from the interior and the exterior of the capped sleeve whereby pond overflow into the standpipe will remain normal;

closing the valve means to prevent equalization of atmospheric pressure from the interior and exterior of the capped sleeve whereby water flow will create vacuum within such sleeve to raise the water level above the top of the standpipe to completely fill the standpipe with water whereby the standpipe will flow fully which will drop the level of the pond until air enters the bottom of the sleeve to break the vacuum and stop the overflow.

2. The method of claim 1 including opening the valve means prior to the pond water level dropping to the bottom of the sleeve whereby intermediate lowering of the pond level can be accomplished.

3. The method of claim 1 including, when the level of the pond is below the top of the stand pipe, providing a vacuum means for reducing the atmospheric pressure within the sleeve to cause the water level therein to rise and flow through the standpipe.

4. The method of claim 1 including providing at least two valve means.

5. The method of claim 1 including providing at least one lift handle means.

6. The method of claim 5 including providing a second handle means on the cap of the sleeve.

7. The method of claim 1 wherein the means for spacing the cap from the top of the stand pipe is a vertical spacer means extending downwardly from the interior of the cap to rest on the top of the standpipe.

8. A method of pond management for maintaining the level of water in a pond comprising the steps of: providing a cylindrical stand pipe in the pond; surrounding said stand pipe with a cylindrical sleeve establishing a cross sectional area between the sleeve and the stand pipe at least equal to the cross sectional area of the stand pipe; providing radial spacer means for maintaining said sleeve and said standpipe in coaxial relationship; installing a cap member at the top of said sleeve; providing axial spacer means for maintaining said cap member above said stand pipe; providing a valve member on said cap member; opening said valve member for maintaining the water level of the pond by equalizing pressure between the interior and exterior of said sleeve permitting pond overflow to enter said stand pipe; and closing said valve member for lowering the water level of the pond by preventing of pressure between the interior and exterior of said sleeve whereby water flow will create vacuum within said sleeve to raise the water level above the top of the standpipe thereby completely filling said stand pipe and allowing flow therethrough until the water level of the pond is below the bottom of said sleeve and air enters the sleeve to break the vacuum and stop the flow therethrough.

* * * * *